US011834246B2

(12) United States Patent
Bunce et al.

(10) Patent No.: US 11,834,246 B2
(45) Date of Patent: Dec. 5, 2023

(54) DEVICE

(71) Applicant: GSK CONSUMER HEALTHCARE SARL, Prangins (CH)

(72) Inventors: Martin Bunce, Wiltshire (GB); Dan Chen, Wiltshire (GB); Gabriella Silvestri, Nyon (CH)

(73) Assignee: GSK Consumer Healthcare SARL, Prangins (CH)

( * ) Notice: Subject to any disclaimer, the term of this patent is extended or adjusted under 35 U.S.C. 154(b) by 0 days.

(21) Appl. No.: 15/755,151

(22) PCT Filed: Aug. 25, 2016

(86) PCT No.: PCT/EP2016/070025
§ 371 (c)(1),
(2) Date: Feb. 26, 2018

(87) PCT Pub. No.: WO2017/036894
PCT Pub. Date: Mar. 9, 2017

(65) Prior Publication Data

US 2018/0244451 A1 Aug. 30, 2018

(30) Foreign Application Priority Data

Aug. 28, 2015 (GB) ..... 1515354

(51) Int. Cl.

| | |
|---|---|
| ***B65D 83/04*** | (2006.01) |
| ***B65D 75/58*** | (2006.01) |
| ***A61J 1/03*** | (2023.01) |
| ***B65D 75/30*** | (2006.01) |

(52) U.S. Cl.
CPC ..... *B65D 75/5811* (2013.01); *A61J 1/03* (2013.01); *B65D 75/30* (2013.01); *B65D 75/5822* (2013.01); *B65D 83/0481* (2013.01); *B65D 2215/00* (2013.01)

(58) Field of Classification Search
CPC ..... B65D 83/04; B65D 83/0481; B65D 75/5811; B65D 75/30; B65D 75/5822; B65D 2215/00; A61J 1/03; B65B 7/02
USPC ..... 206/528, 540; 53/467, 469, 476
See application file for complete search history.

(56) References Cited

U.S. PATENT DOCUMENTS 2,333,587 A * 11/1943 Salfisberg ..... B65D 75/20 383/210
RE24,251 E * 12/1956 Kaplan et al. ..... B65D 75/5811 222/107
2,976,988 A * 3/1961 Schneider ..... B65D 75/5822 206/445

(Continued)

FOREIGN PATENT DOCUMENTS

| | | |
|---|---|---|
| EP | 1990290 A1 | 11/2008 |
| JP | 2001114306 A | 4/2001 |
| WO | WO 9801361 A1 | 1/1998 |

*Primary Examiner* — Luan K Bui

(57) ABSTRACT

A sachet (10) for containing solid tablets (30) having a cavity (11) with an outlet tunnel (20) a long which a tablet (30) can be moved in an outward direction, the outlet tunnel (20) comprising sequential sections (20A, 20B) in the outward direction aligned at a non-180° angle to each other, and the cavity (20) contains at least one solid tablet (30) which can be urged into the inlet opening (21), along the outlet tunnel and out through the outlet opening (22). The angled sections of the outlet tunnel impart child-resistance to the sachet.

16 Claims, 3 Drawing Sheets

(56) References Cited

U.S. PATENT DOCUMENTS

| | | | | | |
|---|---|---|---|---|---|
| 4,491,245 | A * | 1/1985 | Jamison | B65D 75/5822 | 222/107 |
| 4,793,121 | A * | 12/1988 | Jamison | B65B 61/18 | 425/389 |
| 5,018,646 | A * | 5/1991 | Billman | B65D 75/5822 | 222/107 |
| D319,976 | S * | 9/1991 | Wortley | D9/707 | |
| 5,228,782 | A * | 7/1993 | Imer | B65D 75/5822 | 383/200 |
| 5,333,758 | A * | 8/1994 | Jamison | B67D 1/0001 | 222/101 |
| 6,360,916 | B1 * | 3/2002 | Sokolsky | B65D 75/5822 | 222/107 |
| 7,866,475 | B2 * | 1/2011 | Doskoczynski | B65D 75/366 | 206/532 |
| 8,333,510 | B2 * | 12/2012 | Ackermann | B65D 75/5855 | 206/532 |
| 2006/0023976 | A1 * | 2/2006 | Alvater | B65D 81/3266 | 383/200 |
| 2009/0003737 | A1 * | 1/2009 | Risgalla | B65D 75/48 | 428/35.2 |
| 2010/0049161 | A1 | 2/2010 | McAffer et al. | | |
| 2011/0075954 | A1 * | 3/2011 | Kumar | B65D 75/5866 | 383/204 |
| 2013/0167865 | A1 * | 7/2013 | Kerr | B65D 75/5811 | 132/221 |
| 2014/0044381 | A1 * | 2/2014 | Ulstad | B65D 5/2057 | 383/207 |
| 2019/0177016 | A1 * | 6/2019 | Gross-Johnston | B65B 9/023 | |

* cited by examiner

DEVICE

This application is a 371 of International Application No. PCT/EP2016/070025, filed Aug. 25, 2016, which claims the priority of GB Application No. GB 1515354.7 filed Aug. 28, 2015, which is incorporated herein in its entirety.

FIELD OF THE INVENTION

The present invention relates to dispensing containers, particularly to flexible pouches and sachets containing a solid tablet product which can be dispensed from the sachet by squeezing pressure applied by a user to slide a tablet out of the pouch or sachet.

BACKGROUND TO THE INVENTION

Sachets are well known dispensing containers and are widely used for the containing and dispensing therefrom of a wide range of products including medicinal products such as prescription medicines and over-the-counter medicines. Typically a sachet comprises two layers of flexible material defining a product containing cavity between them joined at the perimeter of the cavity. Typical flexible layer materials include metal foil, plastics material, paper etc. or a laminate of two or more such materials, such as known aluminium-propylene laminate materials as available commercially from Amcor™. Typical techniques and processes by which such sachets are made include bringing two sheets of such flexible layer material together, or folding together a single sheet, and sealing the sheets together around the perimeter of an internal cavity between them. Sachets may be made with gussets, or without gussets to thereby allow a larger cavity size for the same area of material. Typically the layers are joined together by welding, e.g. thermal or ultrasonic welding, or an adhesive.

Often such sachets are openable by tearing off a portion of the sachet, typically a corner, to thereby form or expose an outlet opening.

Sachets are known, for example from GB-A-769810, WO-A-88/05013, WO-A-98/01361 and JP-A-2001114306 which have a sinuous outlet tunnel formed between the flexible sheets leading from the cavity towards an outlet opening which is normally closed before use by such a tear-off portion. In these disclosures the cavity in the sachet contains a fluid, and the sinuous outlet tunnel is provided to control flow of fluid as it is squeezed out of the sachet.

Sachets are also used for containing solid products such as tablets. Such tablets are typically dispensed from such sachets by shaking them out of a non restricted simple opening. There is a problem in that children can relatively easily open sachets and access tablets contained therein out of a simple outlet opening, and a related opposite problem in that making a sachet child-resistant can also make it difficult for elderly users to dispense tablets from the sachet.

It is an object of this invention to address this problem. Other objects and advantages of the invention will be apparent from the following description.

SUMMARY OF THE INVENTION

According to a first aspect of the present invention, a sachet is provided comprising two layers of flexible material defining a cavity between them and joined together around the cavity, with an outlet tunnel between said flexible layers along which a product can be moved in an outward direction from the cavity, said outlet tunnel having an inlet opening from the cavity into the outlet tunnel and an outlet opening from the outlet tunnel from which the product can be dispensed from the outlet opening, the outlet tunnel comprising sequential sections in the outward direction aligned at a non-180° angle to each other;

wherein the cavity contains at least one solid tablet having a shape and dimensions such that the tablet can be urged into the inlet opening, along the outlet tunnel and out through the outlet opening.

The non-180° angle between the sequential sections of the outlet tunnel may be between 90° to 170°, preferably between 120° to 150°.

The sachet of this invention is suitable for all kinds of solid tablets but is especially intended for medicinal tablets. Such tablets may have a generally conventional shape and size, e.g. rectangular or rounded as viewed in plan looking along their shortest dimension. The tablets have a bevelled edge so that applying squeezing pressure to the tablet causes it to move in a direction transverse to the pressure.

According to a second aspect of the present invention, a novel construction of a sachet suitable for containing tablets as above is provided, comprising two layers of flexible material defining a cavity between them and joined together around the cavity, with an outlet tunnel between said flexible layers along which a product can be moved in an outward direction from the cavity, said outlet tunnel having an inlet opening from the cavity into the outlet tunnel and an outlet opening from the outlet tunnel from which the product can be dispensed from the outlet opening, the outlet tunnel comprising two sequential sections being a first section extending outwardly from the inlet opening, and a second section extending in the outward direction from the first section to the outlet opening, and the respective first and second sections meet at an obtuse angle to each other.

Preferably in this second aspect the only sequential sections of the outlet tunnel are said first and second sections.

The obtuse angle (i.e. an angle is one which is more than 90° but less than 180°) in this second aspect may be up to 170° but is preferably between 120° to 150°.

According to a further aspect of the present invention, a process is provided wherein a sachet is made by joining two layers of flexible material together to define a closed cavity between them with an outlet tunnel between said flexible layers along which a product can be moved in an outward direction, said outlet tunnel having an inlet opening from the cavity into the outlet tunnel and an outlet opening from the outlet tunnel from which the product can be dispensed from the outlet opening, the outlet tunnel comprising sequential sections in the outward direction aligned at a non-180° angle to each other, and in which the cavity contains at least one solid tablet having a shape and dimensions such that the tablet can be urged into the inlet opening, along the outlet tunnel and out through the outlet opening.

The invention in its various aspects addresses the above-mentioned problem of making a sachet containing tablets child-resistant by means of the requirement that to dispense a tablet from the sachet the tablet must be urged around the angle(s) between the sections of the outlet tunnel. Although this is likely to be relatively easy for an elderly user who understands the need to urge the tablet product around the angle and consequently succeeds in doing so, the effort of urging a tablet product around the angle(s) is likely to be too much for a small child who is then likely to give up in frustration or impatience. The angle(s) between the sections of the outlet tunnel also provide the further advantage that the angle(s) prevents accidental fall out of the tablets, meaning that the pack remains automatically closed and does not require a specific subsequent opening action. Known sachets typically have very unreliable and inconvenient re-close mechanisms such as stickers or re-usable low tack adhesives, or expensive/complex sealed rigid closures. The angle(s) between the sections of the outlet tunnel eliminates the need for these.

DETAILED DESCRIPTION OF THE INVENTION

Figure 4:
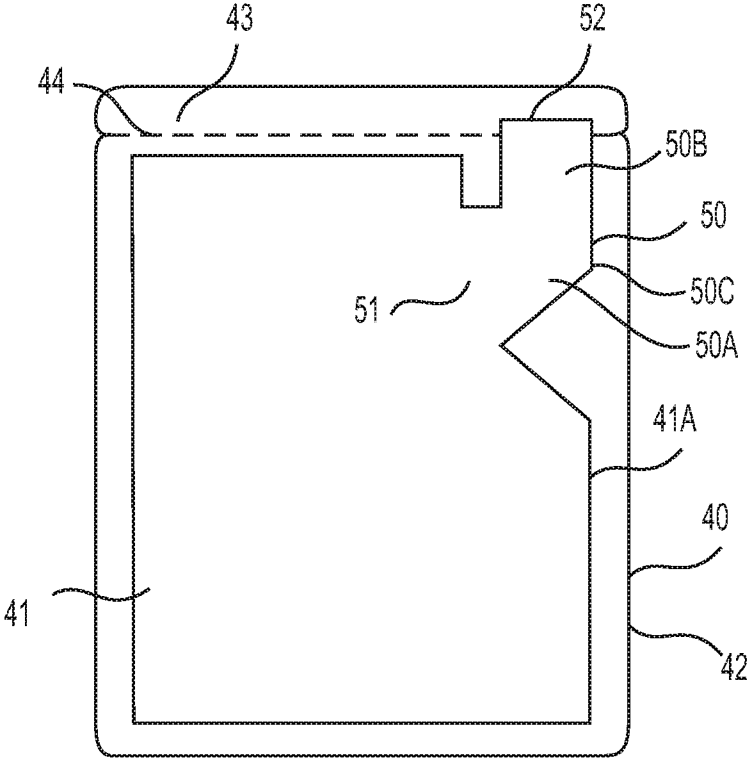
FIG. 4 shows a sectional plan view of another sachet of this invention.

Suitable and preferred embodiments of the invention will now be described.

The sachet is preferably of a generally rectangular shape, this term including square, shapes having at least three major sides at right angles to each other, including such shapes having rounded corners. The cavity is preferably of a shape generally corresponding to the outer shape of the sachet, e.g. a generally rectangular shape cavity within a generally rectangular sachet. Convenient dimensions for a sachet in view of the kind of tablet products likely to be contemplated by this invention, e.g. lozenges for oral administration, are ca. 120×90 mm with a cavity of dimensions ca. 100×75 mm.

The flexible layers may be made of conventional sachet materials, and may be joined together conventionally as described above.

The outlet tunnel is suitably formed as a region between the two layers which is not joined together. Suitably prior to dispensing of product from the sachet, e.g. during storage, the outlet opening of the outlet tunnel is closed for example by means of a conventional tear-off portion, the tearing off of which exposes the outlet opening.

The dimensions of the outlet tunnel to facilitate passage of a tablet along the outlet tunnel will depend upon the shape and size of the tablets to be dispensed from the sachet and can easily be determined empirically. Suitably the cross sectional shape and dimensions of the outlet tunnel should be similar to the cross sectional shape and dimensions of the tablet cut across the direction in which it is to travel along the outlet tunnel. The narrowest cross section area of the outlet tunnel should be the same as or slightly larger than the cross section of the tablet cut across the direction in which it is to travel along the outlet tunnel so as to facilitate the movement of the tablet along the tunnel, although if the layer material is elastically flexible the cross sectional area of the outlet tunnel may be slightly less than that of the tablet so that the tablet can stretch the material as it enters and passed through the tunnel along the outward direction. The dimensions of the outlet tunnel may be such that tablets in the cavity may be urged around the angle(s) between the sections of the outlet tunnel simply by tipping or shaking, i.e. relying on gravity or the impulse applied to the tablet by the shaking action, and/or by pressure applied by a user to the tablet through the layer of flexible material of the sachet to squeeze the tablet along the tunnel.

Preferably the shape of the cavity incorporates a corner, e.g. a corner between two adjacent sides of a generally rectangular shaped cavity, and the inlet opening of the outlet tunnel preferably occupies, or is located adjacent to, this corner of the cavity. Such a location facilitates directing tablets within the cavity toward the outlet opening as a result of the funneling effect of the corner location.

Preferably at least part, e.g. a first section, of the outlet tunnel tapers in the outward direction from the inlet opening, becoming narrower toward the outlet opening, i.e. in the direction in which the tablet travels. Such a shape facilitates the entry of the tablet into the outlet tunnel via the inlet opening of the outlet tunnel. In such a construction suitably a second section of the outlet tunnel downstream from this first section may be parallel sided.

The inlet opening of the outlet tunnel may be edged by rounded or ramped kerb portions, for example to reduce the risk of tearing of the flexible material through contact with a tablet as it enters the inlet opening, and/or to facilitate entry of a tablet into the inlet opening from the cavity.

The sequential sections of the outlet tunnel may be provided by the outlet tunnel following a sinuous, serpentine or zig-zag shape. A zig-zag shape may comprise two or three sequential sections with bends in the tunnel between them.

The above-mentioned angles between the sections of the outlet tunnel, especially the preferred angle range, are selected to optimise both child resistance and the ease with which an elderly user can urge a tablet through the outlet tunnel.

Preferably the sequential sections of the outlet tunnel, e.g. the first and second sections comprise sequential straight sections in communication with each other via a simple elbow bend between them, for example a sharp angled turn, or a radiused bend of minimum practical radius.

The sequential sections of the outlet tunnel, e.g. the first and second sections, may be of approximately the same length, e.g. having lengths that differ by up to 50%, preferably up to 25%.

In a preferred embodiment the sachet is generally rectangular, the cavity is generally rectangular, the inlet opening of the outlet tunnel occupies or is located adjacent to a corner of the cavity, the outlet tunnel comprises a first section extending diagonally from the cavity, e.g. at an angle between 30-60° e.g. ca. 45° to the alignment of an edge of the generally rectangular shaped cavity, and a second section extending parallel to that edge. In such a construction the geometry necessarily causes the respective first and second sections to meet at an obtuse angle of ca. 135° to each other.

The sachet of this invention can also incorporate other child-resistance features, and/or tamper evidence features, which may be generally conventional.

The process of this invention is suitable for manufacture of sachets of both the first and second aspects of the invention, in particular sachets according to the second aspect containing one or more tablet within their cavity.

In the process of the invention the sachet may be made by any essentially conventional process by which such sachets are made such as bringing two sheets of flexible material together, or folding and sealing together a single sheet, to thereby form the joined-together layers of flexible material of the sachet. For example the sachets may be made by a procedure of joining the sheets together around part of the perimeter of the cavity to be formed but leaving part of the perimeter of the sachet open, introducing tablets into the cavity via this opening, then joining the sheets together around the remainder of the perimeter of the cavity to thereby close the cavity, for example using the above-mentioned welding or adhesive techniques. Conventional sachet making machinery can be used to perform this process. For example WO-A-88/05013 describes a sachet-making process.

The invention will now be described by way of example only with reference to the accompanying drawings.

Figure 1:
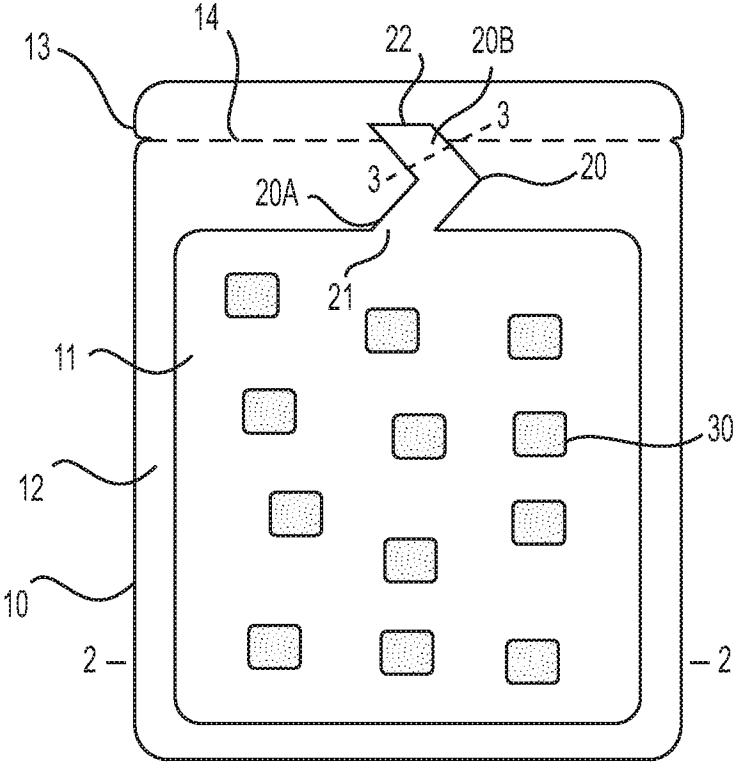
FIG. 1 shows a plan view of a sachet of this invention containing tablets.
Figure 2:
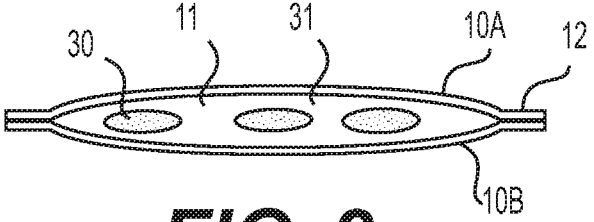
FIG. 2 shows a cross section through the sachet of FIG. 1 at the line A-A of FIG. 1.

Referring to FIG. 1 a sachet 10 is shown overall in a plan view, being of a generally conventional construction comprising two flexible layers 10A and 1013 of a conventional aluminium foil-plastics material laminate, seen in FIG. 2, defining a rectangular cavity 11 between them and joined at 12 at the perimeter of the sachet 10 to form a sealed cavity 11 in a conventional manner by welding.

An outlet tunnel 20 is formed between the said flexible layers 10A, 1013 leading via an inlet opening 21 from the cavity 11 towards an outlet opening 22 of the tunnel. The inlet opening 21 is located at about the midpoint of an edge of the rectangular cavity 21. The outlet opening 22 of the outlet tunnel is closed by a conventional tear-off portion 13 of the sachet 10, which can be torn off along line of weakness 14 to expose the outlet opening 22.

The outlet tunnel 20 comprises two sequential sections 20A and 20B having their orientations at an obtuse angle to each other. As shown in FIG. 1 the sections 20A and 20B are of approximately the same length.

Figure 3:
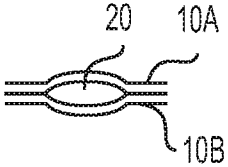
FIG. 3 shows a cross section through the sachet of FIG. 1 at the line B-B of FIG. 1.

The cavity 11 contains tablets 30. As seen in plan view in FIG. 1 along their shortest dimension the tablets are square with rounded corners. As seen in FIG. 2 the tablets 30 have bevelled edges 31 so that applying squeezing pressure to the products 30 causes them to move in a direction transverse to the pressure. As seen in FIG. 3 the tunnel 20 has a cross sectional shape and size similar to the cross sectional shape of the tablet 30 cut across the direction in which it is to travel along the outlet tunnel.

Referring to FIG. 4 another construction of sachet 40 is shown overall in a plan view and being of a generally conventional construction analogous to that of FIG. 1, being rectangular and incorporating a cavity 41 analogously as in FIG. 1. The cavity 41 is generally rectangular in shape having three straight sides at right angles to each other and bounded by sealed perimeter 42. The sachet 40 measures ca. 120×90 mm and the cavity 41 ca. 100×75 mm.

An outlet tunnel 50 is formed analogously as in FIG. 1 leading via an inlet opening 51 from the cavity 11 towards an outlet opening 52 of the tunnel. The outlet opening 52 of the outlet tunnel is closed by a conventional tear-off portion 43 of the sachet 40, which can be torn off along line of weakness 44 to expose the outlet opening 52.

The inlet opening 51 of the outlet tunnel 50 occupies a corner of the overall generally rectangular shape of the cavity 41 and comprises a first section 50A extending from the cavity at an angle ca. 45° diagonally to the adjacent edge 41A of the generally rectangular shaped cavity 41, and a second section 50B extending parallel to that edge 41A, the sections 50A, 50B meeting at the angular elbow 50C. Consequently the first and second sections 50A, 50B have their respective orientations meeting at an angle of ca. 135° to each other.

The cross section of the outlet tunnel 50 of FIG. 4 is similar to that shown in FIG. 3.

In the embodiment shown in FIG. 4 the first section 50A of the outlet tunnel tapers in the direction becoming narrower toward the outlet opening 52, i.e. in the outward direction in which tablets (not shown) in the cavity 41 would travel on dispensing. The second section 50B downstream in the outward direction is parallel-sided across its flow path direction and has a width of ca. 15 mm.

Figure 5:
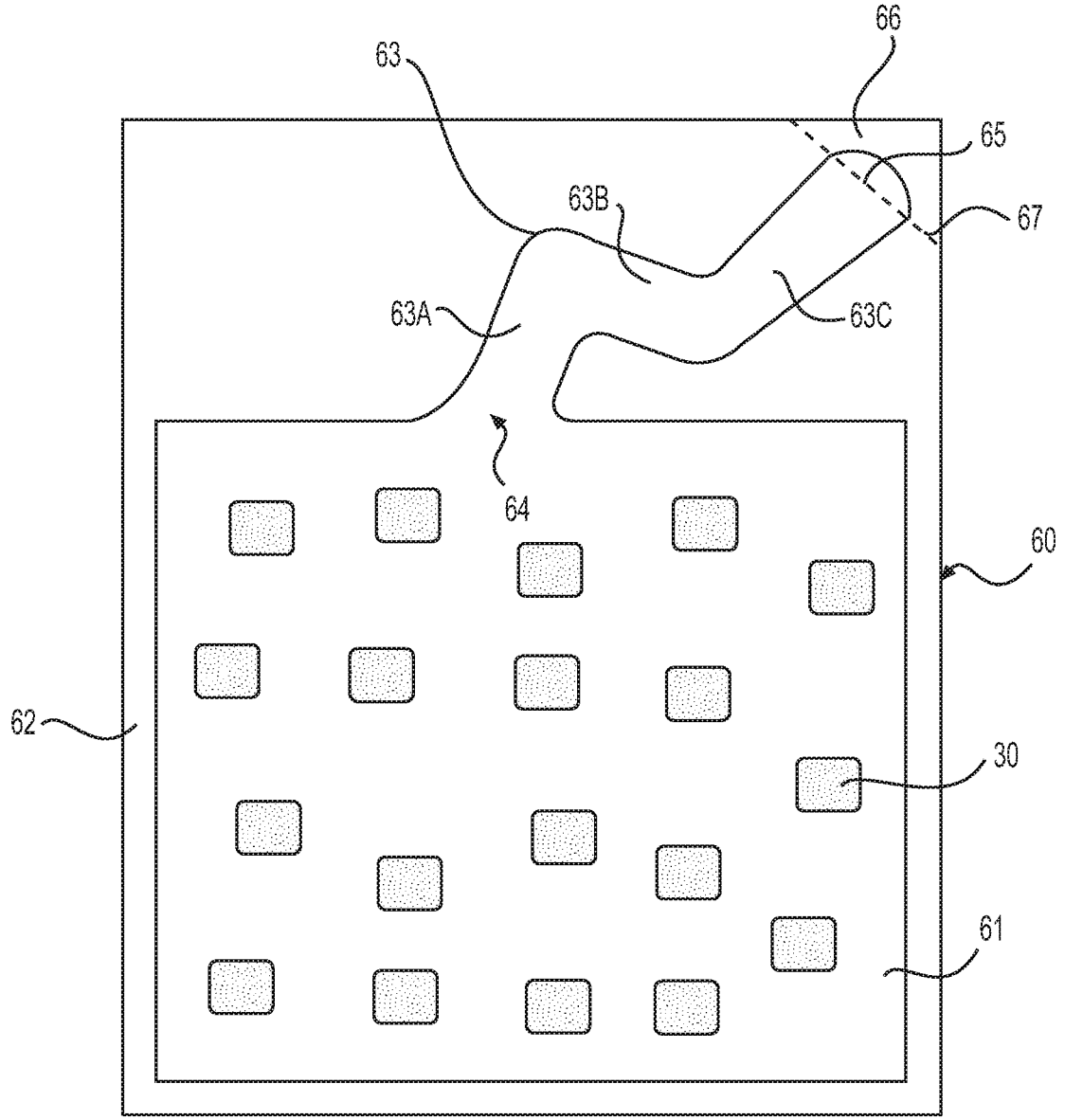
FIG. 5 shows a sectional plan view of another sachet of this invention.

Referring to FIG. 5 another construction of sachet 60 is shown overall in a plan view, being of a generally conventional construction analogous to that of FIG. 1, being rectangular and incorporating a rectangular cavity 61 analogously as in FIG. 1 bounded by sealed perimeter 62.

An outlet tunnel 63 is formed analogously as in FIG. 1 leading via an inlet opening 64 from the cavity 61 towards an outlet opening 65 of the tunnel. The outlet opening 65 of the outlet tunnel is closed by a conventional tear-off portion 66 of the sachet 60, which can be torn off along line of weakness 67 to expose the outlet opening 65.

The outlet tunnel 63 comprises sequential sections 63A, 63B, 63C having their respective orientations at non-180° angles to each other. The cross section of the outlet tunnel 63 of FIG. 5 is similar to that shown in FIG. 3. The cavity 61 contains tablets 30 analogous to those shown in the sachet of FIG. 1 of sectional dimensions corresponding to the sectional dimensions of the outlet tunnel 63.

Figure 7:
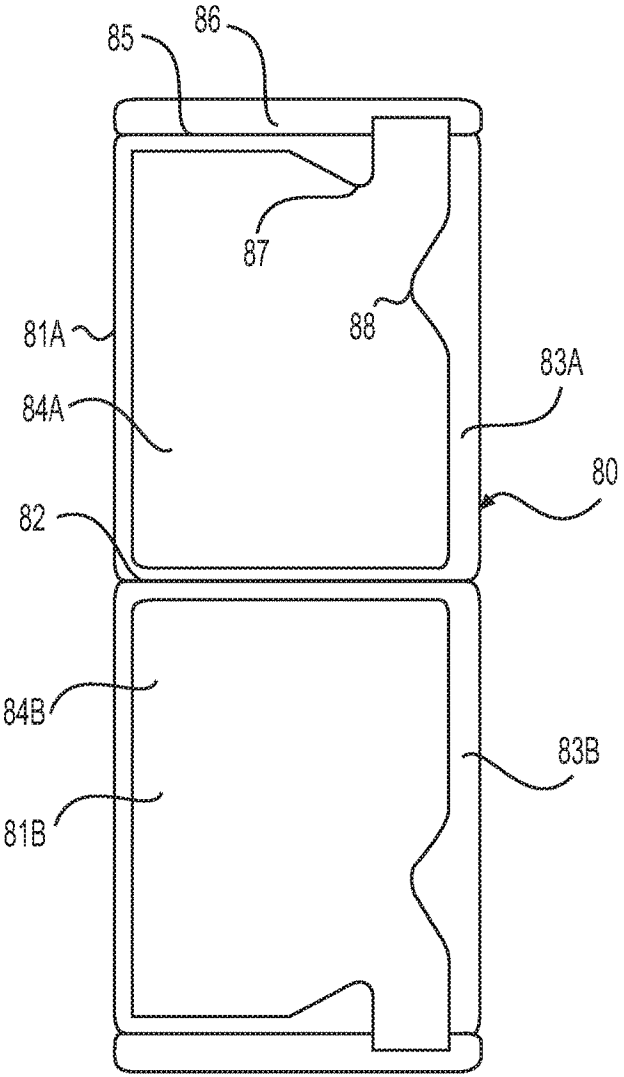
FIGS. 6 and 7 show sheets of material suitable for making sachets of this invention.
Figure 6:
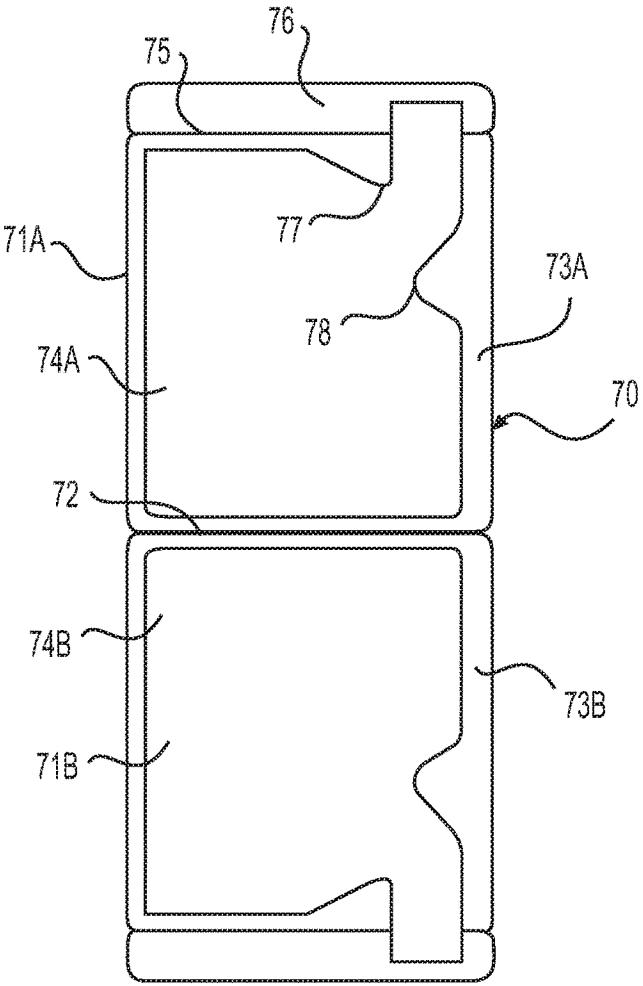

Referring to FIGS. 6 and 7, this shows views of two sheets of flexible sachet layer material 70, 80, each comprising two mirror-image half sheets 71A, 71B and 81A, 81B connected by a fold line 72, 82. Each half sheet 71A, 81A comprises an area 73A, 83A which when the sheet 70, 80 is folded about its respective fold line 72, 82 will be joined, e.g. by conventional welding, adhesive etc. to a corresponding area 73B, 83B on the opposite half sheet 71B, 81B to thereby form a sealed sachet analogous to the sachets of FIGS. 1-5. Each half sheet 71A, 71B, 81A, 81B includes areas 74A, 74B, 84A, 84B which when the half sheets are folded at line 72, 82 and joined at 73A, 73B and 83A,83B define a correspondingly shaped cavity and outlet tunnel analogous to those of FIGS. 1, 4 and 5. The areas 74A, 74B, 84A, 84B of each sheet 70, 80 may be made concave downwards relative to the plane of the drawing of FIGS. 6 and 7 to thereby modify the dimensions and volume of the cavity and outlet tunnel that are formed when the sheets 70, 80 are folded and joined together in this way.

It will be apparent from FIGS. 6 and 7 that the cavity and outlet tunnel which would be formed on folding the sheets 70, 80 in this way would be similar to that shown in FIG. 4, i.e. a cavity of generally rectangular shape having three major straight sides at right angles to each other, an outlet tunnel occupying a corner of the cavity comprising a tapering first section extending from the so-formed cavity at an angle ca. 45° diagonally to the adjacent edge of the cavity to be formed and a second parallel sided section extending parallel to that edge, the sections meeting at an angular elbow. The half sheets 71A, 71B, 81A, 81B incorporate a line of weakness 75, 85 in the areas 73A, 73B, 83A, 83B which when the sheets 70, 80 are folded as above forms a line of weakness analogous to that 14, 44, 67 of FIGS. 1, 4 and 5 along which the so-formed sachet can be torn to tear off the tear-off portion 76, 86 to open the so-formed outlet tunnel.

In FIGS. 6 and 7 the overall outer dimensions of the half sheets 71A, 71B are ca. 120×90 mm, those of the half sheets 81A, 81B ca. 130×90 mm, and the width of the parallel sided second section of the outlet tunnel which is formed when the sheets 70, 80 are folded is ca. 16 mm.

It is also seen in FIGS. 6 and 7 that the shape of the areas 73A, 73B, 83A, 83B are such as to provide rounded 77, 87 kerb portions (radius respectively ca. 2.5 and 3.5 mm) and ramped 78, 88 kerb portions at the inlet opening of the outlet tunnel formed when the sheets 70, 80 are folded as above.

In use in the process of the invention, the sheets 70, 80 are folded about their respective fold lines 72, 82 and the respective areas 73, 83 are joined as described above around part of the perimeter of the respective areas 74A, 74B, 84A, 84B of each sheet 70, 80, for example along the two opposite long edges of the half sheets 71A, 71B, 81A, 81B extending perpendicular to the fold line 72, 82 whilst leaving the areas 73, 83 along the short edge of the half sheets 71A, 71B, 81A, 81B un-joined to thereby form an open-mouthed pouch. Thereafter, following a conventional sachet filling process, tablets, e.g. those shown 30 in FIGS. 1 and 5 may then be filled into these pouches via the open mouth and the un-joined parts of the areas 73, 83 then joined in a conventional manner to thereby seal the sachet closed.

The sachets 10, 40, 60 of FIGS. 1, 4 and 5, and as formed from the sheets 70, 80 of FIGS. 6 and 7 are used in a similar manner. The sachets 10, 40, 60 are provided with their outlet tunnel 20, 50, 63 closed by respective tear off portions 13, 43, 66. Prior to use, tear off portion 13, 43, 66 of the respective sachets of FIGS. 1, 4 and 5 is torn off to expose the outlet opening 22, 52, 65. The tablets 30 within the cavity 11, 41, 61 may then be urged by squeezing through the flexible layers 10A, 1013 to apply pressure to the tablet 30 to direct it into the outlet opening 21, 51, 64 and thence into the outlet tunnel 20, 50, 63. In the sachet of FIG. 4 the tapered shape of the first portion 51 of the outlet tunnel facilitates the entry of the tablet 30 into the outlet tunnel 20, 50 via the inlet opening 21, 51 of the outlet tunnel.

Thereafter the tablet 30 can relatively easily be negotiated along the outlet tunnel 20, 50, 63 and around the angles 20C, 50C and between the sections 63A, 63B, 63C by a mature or elderly user, but negotiating these angles is relatively difficult for a child who is then likely to give up in frustration or impatience, thereby introducing a degree of child-resistance into the sachet 10, 40, 60.

The invention claimed is:

1. A child-resistant sachet comprising two layers of flexible material defining a cavity between the two layers of flexible material, wherein the two layers of flexible material are joined together around the cavity, with an outlet tunnel between said layers of flexible material along which a product can be moved in an outward direction from the cavity, said outlet tunnel having an inlet opening from the cavity into the outlet tunnel and an outlet opening from the outlet tunnel from which the product can be dispensed from the outlet opening, the outlet tunnel comprising sequential sections in the outward direction aligned at a non-180° angle to each other; wherein the non-180° angle between the sequential sections of the outlet tunnel is between 120° and 150°, wherein the angles optimize child resistance of the sachet;

wherein the cavity contains at least one solid tablet having a shape and dimensions such that the tablet can be urged into the inlet opening, along the outlet tunnel and out through the outlet opening; and wherein the sequential sections of the outlet tunnel comprise sequential straight sections each in communication with each other via an elbow bend between them.

2. A sachet according to claim 1 wherein the cross sectional shape and dimensions of the outlet tunnel is similar to the cross sectional shape and dimensions of the tablet cut across the direction in which it is to travel along the outlet tunnel.

3. A child-resistant sachet comprising two layers of flexible material defining a cavity between the two layers of flexible material, wherein the two layers of flexible material are joined together around the cavity, with an outlet tunnel between layers of flexible material along which a product can be moved in an outward direction from the cavity, said outlet tunnel having an inlet opening from the cavity into the outlet tunnel and an outlet opening from the outlet tunnel from which the product can be dispensed from the outlet opening, the outlet tunnel comprising two sequential sections being a first section extending outwardly from the inlet opening, and a second section extending in the outward direction from the first section to the outlet opening, and the respective first and second sections meet at an obtuse angle between 120° and 150° to each other, wherein the angles optimize child resistance of the sachet;

wherein the cavity contains at least one solid tablet having a shape and dimensions such that the tablet can be urged to travel around the angle between the first and second sections of the outlet tunnel and out through the outlet opening.

4. A sachet according to claim 3 being of a generally rectangular shape with the cavity of a rectangular shape.

5. A sachet according to claim 3 wherein the outlet tunnel is formed as a region between the layers of flexible material which is not joined together.

6. A sachet according to claim 3 wherein the inlet opening of the outlet tunnel occupies or is located adjacent to a comer of the cavity.

7. A sachet according to claim 3 wherein at least part of the outlet tunnel tapers in the outward direction from the inlet opening, becoming narrower toward the outlet opening.

8. A sachet according to claim 7 wherein the first section of the outlet tunnel extending outwardly from the inlet opening tapers becoming narrower toward the outlet opening.

9. A sachet according to claim 8 wherein the second section of the outlet tunnel extending in the outward direction from the first section is parallel sided.

10. A sachet according to claim 3 wherein the outlet tunnel following a sinuous, serpentine or zig-zag shape.

11. A sachet according to claim 3 wherein the sequential sections of the outlet tunnel comprise sequential straight sections each in communication with each other via an elbow bend between them.

12. A sachet according to claim 3 wherein the sequential sections of the outlet tunnel are in communication via an elbow bend between them.

13. A sachet according to claim 3 wherein the sequential sections of the outlet tunnel are of approximately the same length.

14. A sachet according to claim 3 wherein the sachet is generally rectangular, the cavity is generally rectangular, the inlet opening of the outlet tunnel occupies or is adjacent to a comer of the cavity, the outlet tunnel comprises the first section extending diagonally from the cavity at an angle between 30-60° to the alignment of an edge of the rectangular shaped cavity, and the second section extending parallel to that edge.

15. A sachet according to claim 3 wherein the cavity contains the at least one solid tablet of dimensions such that it may be urged out of the sachet via the outlet tunnel by means of squeezing pressure applied to the at least one solid tablet through the layers of flexible material of the sachet.

16. A process wherein a child-resistant sachet is made by joining two layers of flexible material together to define a closed cavity between the two layers of flexible material with an outlet tunnel between said layers of flexible material along which a product can be moved in an outward direction, said outlet tunnel having an inlet opening from the cavity into the outlet tunnel and an outlet opening from the outlet tunnel from which the product can be dispensed from the outlet opening, the outlet tunnel comprising sequential sections in the outward direction aligned at a non-180° angle to each other, wherein the non-180° angle between the sequential sections of the outlet tunnel is between 120° and 150°, wherein the angles optimize child resistance of the sachet, and in which the cavity contains at least one solid tablet having a shape and dimensions such that the tablet can be urged into the inlet opening, along the outlet tunnel and out through the outlet opening.

* * * * *